US005195473A

United States Patent [19]

Kano et al.

[11] Patent Number: 5,195,473

[45] Date of Patent: Mar. 23, 1993

[54] ROCKER ARM AND METHOD OF CASTING

[75] Inventors: Makoto Kano; Ichiro Tanimoto, both of Yokohama; Osamu Kawamura; Teruo Takahashi, both of Nogimachi, all of Japan

[73] Assignees: Nissan Motor Company, Ltd., Yokohama; Nippon Piston Ring Co., Ltd., Tokyo, both of Japan

[21] Appl. No.: 821,908

[22] Filed: Jan. 15, 1992

Related U.S. Application Data

[63] Continuation of Ser. No. 569,440, Aug. 20, 1990, abandoned.

[30] Foreign Application Priority Data

Sep. 8, 1989 [JP] Japan ..... 1-231732

[51] Int. Cl.[5] ..... B22D 27/20; F01L 1/18

[52] U.S. Cl. ..... 123/90.39; 123/90.51; 164/56.1; 164/57.1

[58] Field of Search ..... 164/57.1; 58.1, 55.1, 164/56.1; 123/90.51, 90.39; 74/559

[56] References Cited

U.S. PATENT DOCUMENTS 4,638,847 1/1987 Day ..... 164/55.1
4,870,931 10/1989 Nakamura et al. ..... 123/90.51 X

FOREIGN PATENT DOCUMENTS 2925822 1/1981 Fed. Rep. of Germany ..... 164/57.1
56-163060 12/1981 Japan ..... 164/57.1
57-91869 6/1982 Japan ..... 164/58.1
59-130648 7/1984 Japan ..... 164/55.1
59-137157 8/1984 Japan ..... 164/55.1
63-303030 12/1988 Japan .
64-29605 1/1989 Japan ..... 123/90.39
996076 2/1983 U.S.S.R. ..... 164/57.1

OTHER PUBLICATIONS

"Imono Binran" (Handbook of Casting), Edited by Japan Casting Assn, Oct. 30, 1980 (3rd Edition), Maruzen Co., Ltd., p. 845, line 1–p. 846, line 1, Section 14. Gray Cast Iron, Chapter 14.3 Molten Metal Treatment, 14.3.1 Addution in Ladle (Inoculation).

"Yokai Chuzo, Imono" (Melting and Casting), Edited by Ryukichi Hashiguchi, Aug. 10, 1970 (11th Edition), Publisher: Asakura Shoten, Ltd., p. 163, line 8–p. 164, line 9, Section 6, Melting of Cast Iron, Chapter 8., Improvements in Molten Metal–8.1 Inoculation.

*Primary Examiner*—J. Reed Batten, Jr.

[57] ABSTRACT

In a process of casting a rocker arm as one piece from high chrome cast iron, a Ca-Si base addition agent is added to the molten metal in an amount of 0.3 to 0.6% by weight. The agent is effective as a globulizer to round high-hardness carbide precipitates directing toward the casting surface.

7 Claims, 3 Drawing Sheets

ROCKER ARM AND METHOD OF CASTING

This application is a continuation of application Ser. No. 07/569,440 filed on Aug. 20, 1990, now abandoned.

BACKGROUND OF THE INVENTION

1. Field of the Invention

The present invention relates to a method of making a rocker arm utilizable as an element of a valve mechanism in an automotive internal combustion engine.

2. Description of the Prior Art

Anti-wear rocker arms, as described in JP A Sho 63-303030, are producible as one piece from high chrome cast iron by casting. The anti-wear property results from high-hardness carbides such as $(Fe, Cr)_7C_3$ in the matrix.

High-hardness Fe-Cr-composite carbides tend to form a directional solidification in which acicular precipitates direct to the casting surface. When a rocker arm makes a sliding engagement with a cam member, the acicular carbides abrade the sliding surface of the associated cam member. It is known that acicular carbides can be rounded or globulized when tungsten is added in an amount of more than 10% by weight to the high chrome cast iron. However, it can not be a solution to the problem, because the addition of more than 10% of tungsten is costly. What is worse, tungsten produces tungsten carbides that are highly hard and abrasive to the cam member.

SUMMARY OF THE INVENTION

The present invention is intended to solve the problem as described above and has as an object to provide a method of manufacturing a rocker arm that is less abrasive to the associated cam member.

The present invention is achieved as a result of extensive research made from a finding that an addition agent for treating molten high chrome cast iron is effective to globulize Fe-Cr-composite carbides.

In accordance with the present invention, a Ca-Si base addition agent is added in an amount of 0.3 to 0.6% by weight to a molten metal in a process of casting a rocker arm as one piece from high chrome cast iron.

The Ca-Si base addition agent contains about 30% of Ca, about 60% of Si, and about 10% of impurities. One or more of Ba, Sr, Mg, Zr, Ce, Mn, and Al may be added in an amount of 0.5 to 5% by weight to the agent.

The high chrome cast iron contains more than 10% of Cr and preferably has the composition consisting, by weight, of C: 2.5–3.7%, Si: 1.0–2.0%, Mn: 0.5–1.0%, Cr: 15–20%, Ni: 0.3–0.7%, P: no more than 0.3%, S: no more than 1.0%, and Fe and unavoidable impurities: the balance. The cast iron may additionally contain one or more of W, Mo, V, Nb, Ta, Ti, and B in an amount of 3 to 10%, by weight, if necessary.

When the Ca-Si base addition agent is added to the molten metal not as a deoxidizer but as a globulizer, it should be added in an amount of no less than 0.3% by weight. The amount of less than 0.3% of the agent is insufficient to round carbide precipitates or achieve the object of the present invention. On the other hand, the amount of more than 0.6% increases cost without more improvement of the roundness. Therefore, the addition agent should be added to the molten metal in an amount of 0.3 to 0.6% by weight. The Ca-Si base addition agent is moderate in reaction, operable with ease, and contributable to a high yield.

When such elements as Ba, Sr, Mg, Zr, Ce, Mn, and Al are added to the Ca-Si base addition agent, the rounding of Fe-Cr carbides is accelerated. The reason for this is that these elements have not only the action to retard the fading of the inoculation-effect but also a high deoxidation due to a strong affinity to oxygen. However, when these elements are added in an amount of less than 0.5% by weight, the desired effect is not obtained, but in an amount of more than 5% by weight, no more improvement is expected. Therefore, the elements should be added in amount of 0.5 to 5% by weight to the agent.

The inventive method of casting a rocker arm as one piece from high chrome cast iron is characterized in that a Ca-Si base addition agent is added to the molten metal in an amount of 0.3 to 0.6% by weight. The Ca-Si base addition agent is effective not only to deoxidize the molten metal but also to globulize precipitates of Fe-Cr carbide. As compared with the conventional method in which the addition agent is given as a single deoxidizer to allow Fe-Cr carbides to form acicular precipitates, the method of the invention can produce a rocker arm of the type having globular precipitates of Fe-Cr carbide. This results is the advantages that the rocker arm is the same in abrasion resistance as the conventional but less aggressive against the other member and thus the cam member is less worn when coupled with the inventive rocker arm than when coupled with the conventional one.

BRIEF DESCRIPTION OF DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

The present invention is described in detail with the sample rocker arms made from high chrome cast iron in which the molten metal has the following composition by weight:

TC: 3.50%
Si: 1.50%
Mn: 0.70%
Ni: 0.50%
Cr: 18.00%
Mo: 1.00%
W : 5.00%
Fe: Balance In the process of casting, the molten metal of each sample was treated with the individual agent of which the content, amount and elements added are given in Table 1. Every sample was hardened and tempered in the same way after casting. The samples were classified to 11 Examples and 2 Comparisons on the basis of the composition of the addition agent. Examples and Comparisons except Examples 3, 7, 9, 11 were etched and photomicrographed as illustrated in FIGS. 1 to 9. The photomicrographs show white carbide grains distributed in the black pearlitic matrix. Each photomicrograph was analyzed by an image analyzer by which both the real and circumcircular areas of each carbide grain were measured for calculation of the ratio of the former to the latter. The average value of the ratios indicates the roundness or globularity of each of Examples and Comparisons. The values of globularity are also given in Table 1.

TABLE 1

Figure 1:
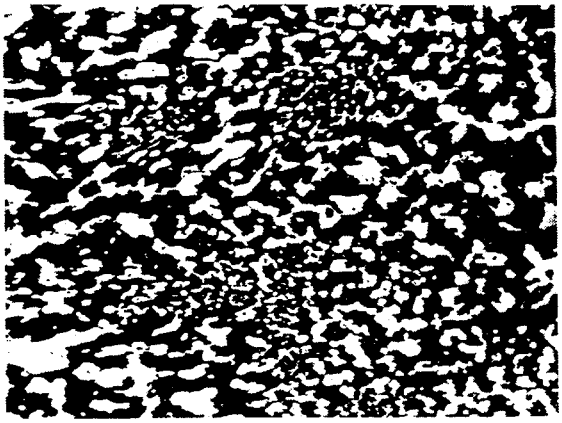
FIGS. 1 to 7 are photomicrographs showing the metal structure of Examples according to the present invention.
Figure 2:
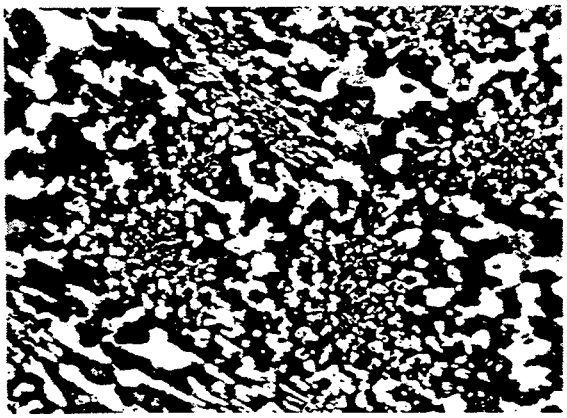
Figure 3:
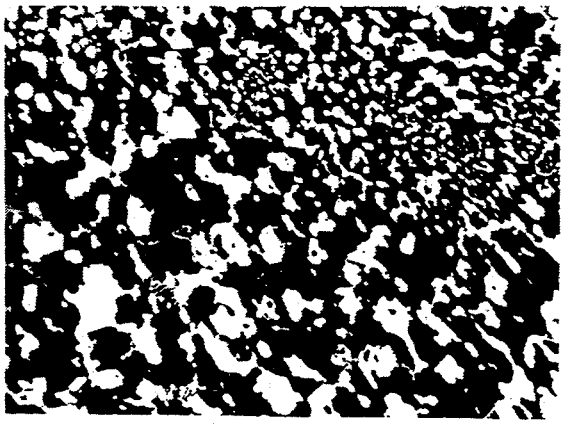
Figure 4:
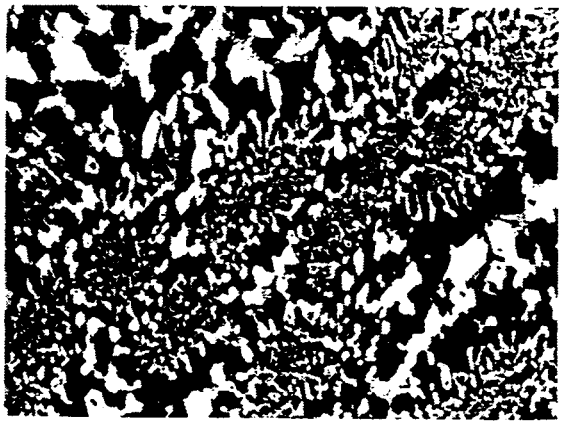
Figure 5:
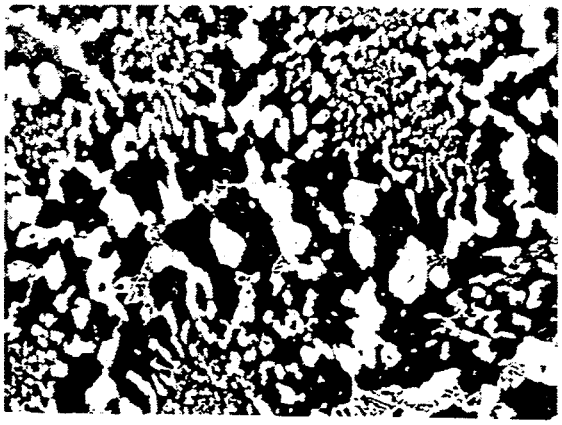
Figure 6:
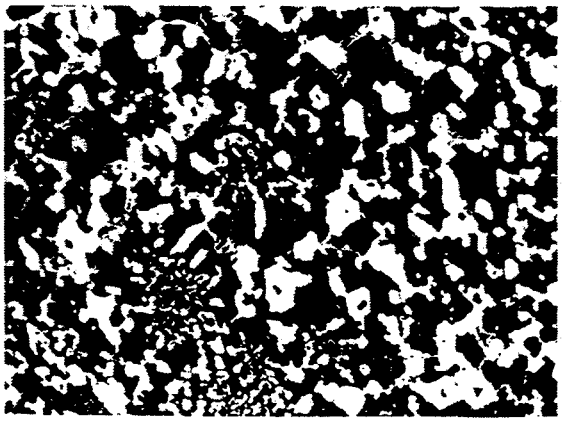
Figure 7:
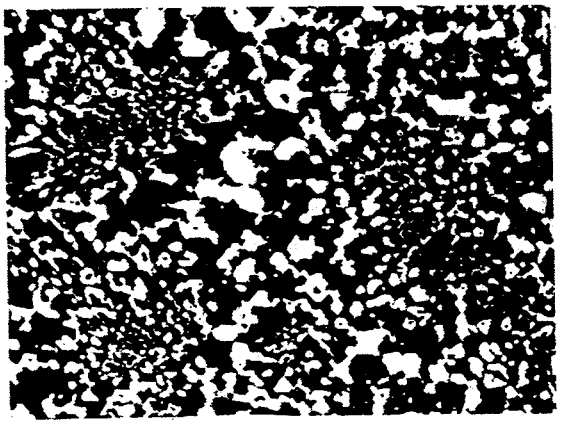

| SAMPLES | Globularity |
|---|---|
| Example 1 shown in FIG. 1<br>Agent: Ca—Si: 0.4%<br>(Elements added: none) | 43% |
| Example 2 shown in FIG. 2<br>Agent: Ca—Si: 0.3%<br>(Elements added: Ba: 2%) | 45% |
| Example 3 not shown<br>Agent: Ca—Si: 0.5%<br>(Elements added: Sr: 3%) | 48% |
| Example 4 shown in FIG. 3<br>Agent: Ca—Si: 0.6%<br>(Elements added: Mg: 2%) | 50% |
| Example 5 shown in FIG. 4<br>Agent: Ca—Si: 0.4%<br>(Elements added: Zr: 3%) | 42% |
| Example 6 shown in FIG. 5<br>Agent: Ca—Si: 0.4%<br>(Elements added: Ba: 1%, Zr: 1%) | 47% |
| Example 7 not shown<br>Agent: Ca—Si: 0.5%<br>(Elements added: Sr: 1%, Mg: 1%) | 52% |
| Example 8 shown in FIG. 6<br>Agent: Ca—Si: 0.5%<br>(Elements added: Mn: 3%) | 45% |
| Example 9 not shown<br>Agent: Ca—Si: 0.4%<br>(Elements added: Ce: 3%) | 43% |
| Example 10 shown in FIG. 7<br>Agent: Ca—Si: 0.5%<br>(Elements added: Ba: 2%, Mg: 1%, Ce: 0.5%) | 55% |
| Example 11 not shown<br>Agent: Ca—Si: 0.4%<br>(Elements added: Zr: 2%, Sr: 1%, Mn: 1%) | 48% |
| Comparison 1 shown in FIG. 8<br>Agent: Al: 0.4%<br>(Elements added: none) | 28% |
| Comparison 2 shown in FIG. 9<br>Agent: Ca—Si: 0.2%<br>(Elements added: none) | 32% |

Figure 8:
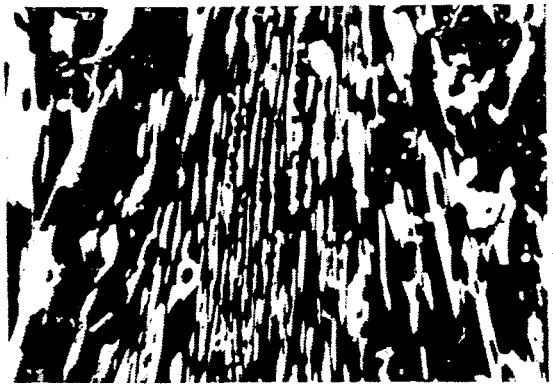
FIGS. 8 and 9 are photomicrographs showing the metal structure of Comparisons.
Figure 9:
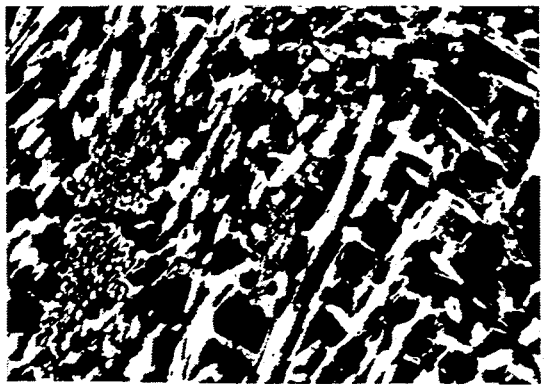

As seen in FIGS. 1 to 7, Examples have carbides in the shape of globular grains. In contrast, FIGS. 8 and 9 show that Comparisons have carbides in the shape of sharp or acicular grains. This difference in shape of carbides is also understood from the values of globularity in Table 1. Examples have the globularities of more than 42% while Comparisons have the globularities of 28% and 32%. It is known that, when the rocker arm has the globularity of more than 40%, it is unaggressive against the associated cam member with the result that the cam member is improved in weariness.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

What is claimed is:

1. A method of making a rocker arm from a high chrome cast iron metal by casting, characterized in that a Ca-Si base addition agent is added in an amount of 0.3 to 0.6% by weight to the molten high chrome cast iron metal to globulize carbide precipitates, and said high chrome cast iron metal comprising, by weight, 2.5 to 3.7% of C, 1.0 to 2.0% of Si, 0.5 to 1.0% of Mn, 15 to 20% of Cr, 0.3 to 0.7% of Ni, no more than 0.3% of P, no more than 1.0% of S and 3 to 10% of at least one of W, Mo, V, Nb, Ta, Ti and B.

2. The method of claim 1, wherein at least one member selected from the group consisting of Ba, Sr, Mg, Zr, Ce, Mn, and Al is added in an amount of 0.5 to 5% by weight based on the weight of the Ca-Si base addition agent.

3. The method of claim 1, wherein said high chrome cast iron contains Cr in an amount of 10% or more by weight.

4. An as-cast rocker arm for an internal combustion engine made from a casting composition comprising:

a high chrome cast iron metal, and a Ca-Si base addition agent which is present in an amount of 0.3 to 0.6% by weight based on the weight of the metal, said high chrome cast iron metal comprising, by weight, 2.5 to 3.7% of C, 1.0 to 2.0% of Si, 0.5 to 1.0% of Mn, 15 to 20% of Cr, 0.3 to 0.7% of Ni, no more than 0.3% of P, no more than 1.0% of S and 3 to 10% of at least one of W, Mo, V, Nb, Ta, Ti and B.

5. The rocker arm of claim 4, wherein the addition agent contains about 30% by weight Ca, about 60% by weight Si, with the substantial balance being impurities.

6. The rocker arm of claim 5, wherein at least one member selected from the group consisting of Ba, Sr, Mg, Zr, Ce, Mn, and Al, is added in an amount of 0.5 to 5% by weight based on the weight of the addition agent.

7. The rocker arm of claim 4, wherein the high chrome cast iron contains Cr in an amount of 10% or more by weight.

* * * * *